US007283014B2

(12) United States Patent
Johnson

(10) Patent No.: US 7,283,014 B2
(45) Date of Patent: Oct. 16, 2007

(54) HIGH POWER ABSORBING WAVEGUIDE TERMINATION FOR A MICROWAVE TRANSMISSION LINE

(76) Inventor: Ray M. Johnson, 22661 Highway 62, Shady Cove, OR (US) 97539

( * ) Notice: Subject to any disclaimer, the term of this patent is extended or adjusted under 35 U.S.C. 154(b) by 185 days.

(21) Appl. No.: 11/259,638

(22) Filed: Oct. 25, 2005

(65) Prior Publication Data

US 2006/0087381 A1 Apr. 27, 2006

Related U.S. Application Data

(60) Provisional application No. 60/622,470, filed on Oct. 25, 2004.

(51) Int. Cl.
*H01P 1/26* (2006.01)

(52) U.S. Cl. ..... 333/22 R; 333/22 F

(58) Field of Classification Search ..... 333/22 R, 333/22 F, 81 B

See application file for complete search history.

(56) References Cited

U.S. PATENT DOCUMENTS 2,881,399 A 4/1959 Leyton
3,040,252 A 6/1962 Novak
3,147,451 A 9/1964 Merdinian
3,241,089 A 3/1966 Treen
3,597,708 A 8/1971 Perreault
3,624,566 A 11/1971 Perreault
3,634,784 A 1/1972 Lesyk et al.
4,516,088 A 5/1985 Johnson et al.

*Primary Examiner*—Stephen E. Jones
(74) *Attorney, Agent, or Firm*—Donald L. Beeson; Beeson Skinner Beverly, LLP

(57) ABSTRACT

A high power absorbing waveguide termination for a microwave transmission line has a power receiving end with a waveguide input port, an oversize waveguide section, and a transforming waveguide section for connecting the waveguide input port to the oversize waveguide. A dielectric taper disposed in the oversize waveguide section has a fluid passage therethrough to allow fluid, most suitably water, to sweep the taper and absorb microwave power introduced into the oversized waveguide section. Fluid is suitably fed into and extracted from the dielectric taper via a manifold end block at the back end of the oversize waveguide section. The taper is inclined relative to the center axis of the oversize waveguide section so as to position the point end of the taper in a region of very low electric field strength for the oversize waveguide section's fundamental mode. A power monitoring probe is optionally provided at the input port of the waveguide termination.

20 Claims, 3 Drawing Sheets

HIGH POWER ABSORBING WAVEGUIDE TERMINATION FOR A MICROWAVE TRANSMISSION LINE

CROSS-REFERENCE TO RELATED APPLICATIONS

This application claims the benefit of U.S. provisional application No. 60/622,470, filed Oct. 25, 2004.

BACKGROUND OF THE INVENTION

The present invention relates to microwave devices generally and more specifically to matched impedance waveguide termination devices used for absorbing high microwave power propagated down a waveguide transmission line.

In high power microwave applications, it is often necessary to terminate a transmission line with a substantially matched load capable of absorbing and dissipating the power transmitted into the load. Methods of terminating a waveguide transmission line have been developed involving solid materials as the power absorbing medium, however, in most cases the absorbing medium is water or a water mixture. Where such fluid is used the general class of termination devices is generically referred to as "water loads".

In designing a water load it is usually desirable to produce a load with suitable high power handling capability, low power reflection (i.e. low VSWR characteristics), broadband frequency operation, and relative simplicity of manufacture. It is also desirable to achieve these objectives for applications involving high pulse and high average power, typically pulse power levels in the range of megawatts to tens of megawatts or higher over the bandwidth desired, and average power levels as high as kilowatts to hundreds of kilowatts over the bandwidth desired.

A water load that generally meets these objectives at given power levels and frequencies is disclosed in U.S. Pat. No. 4,516,088 to Ray M. Johnson. The Johnson patent discloses a water load wherein water is circulated in a rectangular termination waveguide through a tapered dielectric jacket whose point end is inclined toward the narrow wall of the termination waveguide such that it lies in a region of low electric field strength for the waveguide's fundamental $TE_{01}$ mode. By inclining the dielectric taper carrying the power absorbing water, reflected power can be minimized.

However, as increasingly higher power amplifier and oscillator sources are developed at both lower and higher frequencies, increased heating rates of the water jacketing material and the water within are experienced to the point where existing water load designs become incapable of handling the increased heating rates without deleterious and even catastrophic heating effects. A need therefore exists for a water load design, which reduces heating rates within the load and which consequently increases the water load's power handling capability. A need particularly exists for a water load which provides an increased power absorbing capability and produces relatively low reflected power over the bandwidth of the absorbed microwave power. A need still further exists to provide these characteristics in a water load designed for relatively high frequency applications (X-band and higher), where, as later described in greater detail, the absorption capacity of the water flowing through the water load is diminished.

It is also desirable for certain applications to provide a water load which maintains its performance for all orientations of the guide and for modest changes in fluid temperature. This means that the fluid flow characteristics should be maintained and entrapment of air bubbles prevented for all load orientations; otherwise there will be a deleterious effect upon the amount of power reflected by the termination. Heretofore, water loads have been devised that substantially reduce entrapment of air bubbles and that exhibits low reflected power characteristics. However, such loads are not well adapted for many high power applications and particularly high frequency, broadband applications at relatively high power levels.

The present invention provides a water load for waveguide transmission lines with relatively low reflected power characteristics over the bandwidth of the input waveguide, and with improved power handling capabilities. The present invention also provides a n improved water load capable of handling high power in high frequency applications (generally X-band and higher). The accepted measure of reflective power in waveguide is given by the voltage standing wave ratio, commonly denoted "VSWR." The present invention seeks to provide a water load for high power applications having a VSWR value less that 1.1 for the entire operating frequency range of the input waveguide.

The present invention is also intended to provide a high peak and average power absorbing termination which is mechanically small and easy to construct and assemble.

SUMMARY OF THE INVENTION

A waterload, as defined herein, utilizes water or a water mixture (hereinafter "water") as the microwave absorbing media. That is, the microwave electric field is coupled into water and the dielectric loss of the water converts the microwave energy into heat in the water. The heating rate within the water is proportional to (1) the electric field squared, (2) the frequency and (3) the imaginary part of the complex permittivity of the water.

The heating rate in water, as frequency is increased, rises considerably. For two different fundamental mode waveguide structures and the same input power level, the above terms (1) and (2) together yield a heating rate approximately proportional to the cube of the frequency ratio. The imaginary part of the complex permittivity also increases with frequency (while the real part is relatively unchanged). This loss term, for water, is approximately linear with frequency (in the microwave region). Thus, the overall heating rate is approximately proportional to the fourth power of the frequency ratio (for two different fundamental mode guides and constant input power). Thus, a high power waveguide water load designed for one frequency may be not suitable for higher frequency applications.

It is noted that the average output power from high power tubes may decrease at the inverse of the high to low frequency ratio but the effective heating rate of water would still increase at approximately the cube of the ratio. For example, a factor of 2 in frequency ratio, for the fundamental size guide, yields an expected heating rate ratio of 8, assuming the average power decreases by the above ratio.

In water loads using a dielectric jacket to circulate the water through the load, the dielectric jacket is also subjected to increased heating rates with increasing frequency. The imaginary part of the dielectric constant of the jacket does not vary as rapidly as does water. The guide size reduction with increasing frequency as well as the frequency term itself can still yield a considerable increase in the heating of the dielectric with a resultant failure of the pressure capability of the jacket.

The power density within the water also decays more rapidly as frequency is increased. The skin depth of water (at 35° C. temperature) that is approximately 2.9 cm at a frequency of 3.0 GHz decreases to 0.29 cm at 10 GHz. Since the skin depth is defined as the distance the electric field decays by a factor of (1/e) or 0.368, the power density is the square of this value or a factor of 0.135. Thus, one might expect, for this example, that approximately 86% of the power density within the water is absorbed within 0.29 cm (0.11 inch) of the exposed water surface at 10 GHz compared to 2.9 cm (1.1 inch) for 3.0 GHz.

The temperature rise of the water immediately adjacent to the dielectric jacket, therefore, would be significantly higher at 10 GHz vs 3.0 GHz because of this skin effect, assuming an equivalent heating rate at the interface, because the power is dissipated within a layer that is 1/10 the thickness. This means that cooling of the dielectric jacket would be less efficient at the higher frequency.

The present invention is an improved high power absorbing waveguide termination for a waveguide transmission line which reduces the above described limitations on the power handling capabilities of water loads. The waveguide termination of the invention includes power receiving end that attaches to the waveguide transmission line to be terminated, a waveguide transformer section, suitably a tapered section of waveguide, and an oversize waveguide section terminated by a manifold end block. A dielectric taper extends from the manifold end block into the oversize waveguide section such that the small end of the dielectric taper points toward the waveguide's power receiving end; the taper is additionally inclined with respect to the axis of the oversize waveguide section so as to be laterally displaced, at the tip, to a region of low electric field. The dielectric taper is provided with a fluid circulating passage for circulating fluids throughout the length of the taper from the taper's base to its point end. Fluid circulation within the taper will preferably provide for a substantially complete sweeping of the inside of the taper and for a substantial elimination of air bubbles within the taper. Fluid inlet and outlet passages in the manifold end block communicate with the fluid passage in the taper for conveying fluids into and out of the waveguide taper.

The waveguide transformer section is of a length and has a cross sectional dependence to transform the input fundamental waveguide size to the oversize waveguide cross section with a minimum of reflection and without excessive coupling to propagating modes other than the fundamental $TE_{10}$ in the oversize waveguide section. By stepping up to a oversize waveguide section, the heating rate at the tip and elsewhere along the dielectric taper can be reduced significantly compared to what would be experienced in the standard waveguide to be terminated. Also, because of the enlarged waveguide cross section, the tip, length and base of the dielectric taper can become significantly larger as compared to a water load design such as disclosed in U.S. Pat. No. 4,516,088. This permits larger water flow rates without excessive water pressure drops. The larger flow rate allows for larger power dissipation for the same differential temperature change. Moreover, the tip cross section versus the oversize waveguide cross section can be relatively small, thereby reducing r.f. reflection at the tip of the taper, and the surface volume of water next to the taper jacket increased to provide increased power handling capabilities at higher frequencies where the skin effect becomes significant.

Two separate water circulating methods are described. One method utilizes a planar divider so that water flows on one side of the divider toward the taper tip and returns on the opposite side of the divider. The second method uses an internal tube within the taper wherein water flows toward the tip and returns in the coaxial plenum between the tube and the outside taper.

In another aspect of the invention, the power receiving end of the water load, where the dimensions of the water load correspond to the dimensions of the waveguide to be terminated, has a monitoring probe in the narrow wall of the waveguide (for $TE_{10}$ rectangular guide). Coupling values on the order of −60 db are usually adequate for monitoring power levels or for frequency control subsystems. The electric field of the waveguide is zero at the narrow wall while the large magnetic field, at the narrow wall, is in the direction of the waveguide axis. A coaxial magnetic loop can be used for sampling this field. For higher microwave frequencies, the waveguide becomes quite small so that small coaxial connectors are required for monitoring (or sampling) probes. For SMA connectors (or smaller) fabrication of loops becomes difficult. This usually entails soldering the inner conductor to the outer conductor.

Conversely, a probe hole machined or drilled into the thick input flange of the load is typically below cutoff. The longitudinal magnetic field at the narrow wall (in the guide) does couple to a cutoff $TE_{11}$ circular mode in the hole. This cutoff mode has a transverse magnetic field that is driven by the main guide magnetic field. Normal to this cutoff magnetic field is an electric field. By using an electric field probe that consists of in inclined central conductor of a coaxial connector, the cutoff electric field can be sensed and hence the main waveguide magnetic field is monitored. The coupled power from the monitor has a direct linear relationship to the magnetic field squared at the main waveguide wall. For a traveling wave without reflection (in the main guide), the coupled power is proportional to the guide power.

The narrow wall electric probe has the same rotational dependence as a loop in that the electric field coupled varies from maximum to zero and back to maximum as the probe is rotated through 180° around the coax axis.

DETAILED DESCRIPTION OF PREFERRED EMBODIMENT

Figure 1:
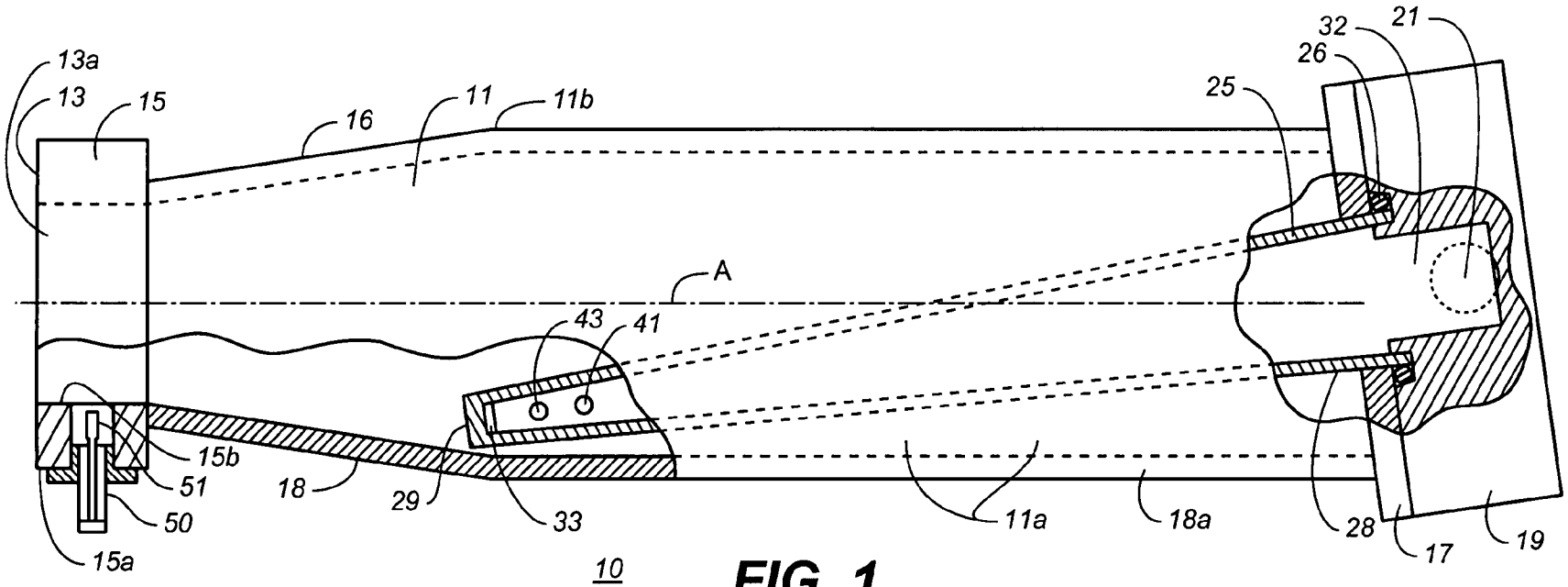
FIG. 1 is a top plan view, in partial cross-section, of one embodiment of the waveguide termination of the present invention.
Figure 2:
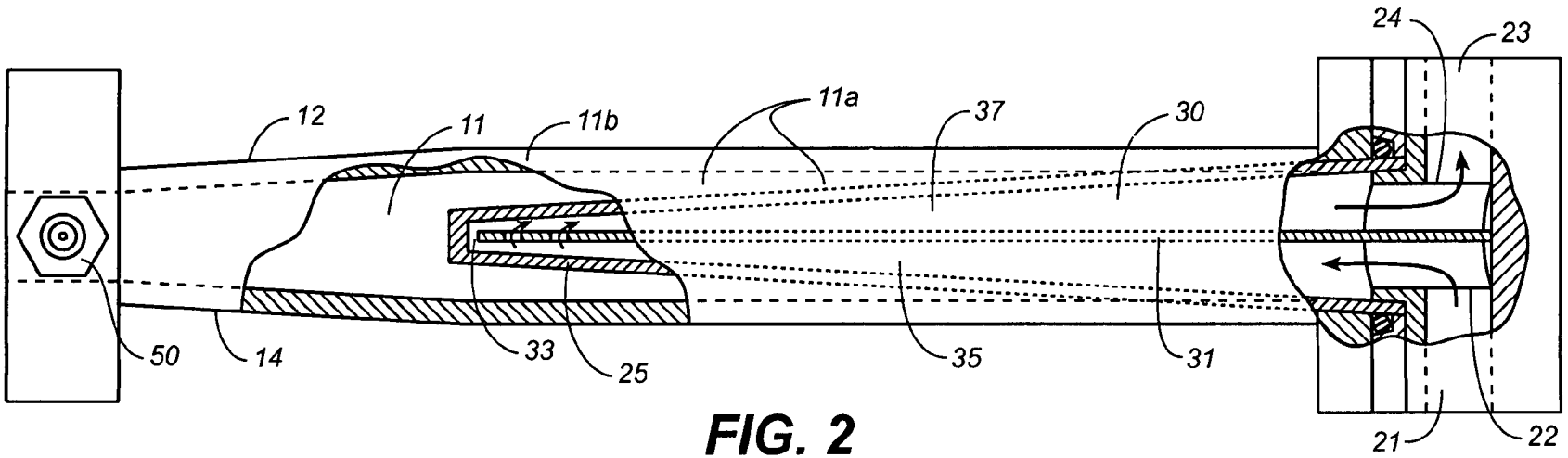
FIG. 2 is a side elevational view thereof, in partial cross-section.
Figure 3:
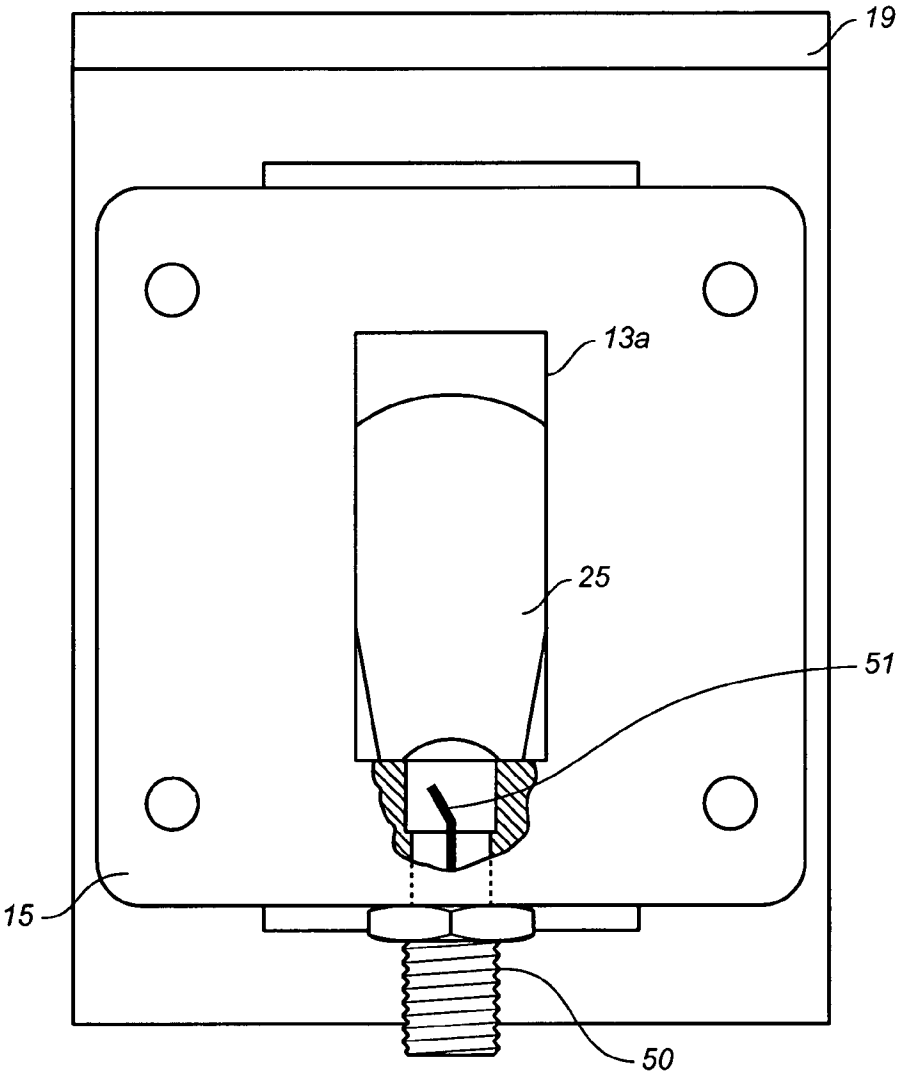
FIG. 3 is an enlarged front elevational view thereof, partially cross-sectioned to illustrate an orientation of the center conductor of the described power sampling probe of the illustrated waveguide termination of the invention.

Referring now to the drawings, FIGS. 1-3 show a power absorbing waveguide termination, generally denoted by the number 10, comprised of a tapered transforming section of rectangular waveguide 11, an oversize waveguide section 11*a* having back end 17, and a power receiving end 13 having an waveguide input port 13*a* sized in correspondence with the terminated transmission line waveguide. The waveguide termination 10 attaches to the transmission line to be terminated at its power receiving end by means of a waveguide flange 15. (The illustrated flange 15 is a relatively thick flange for a power monitoring probe as hereinafter described.) The tapered waveguide section, which is disposed between the oversize waveguide section and power receiving end 13, acts to match the input port 13*a* to oversize waveguide section 11*a* so that microwave power received by the termination's power is conducted to the oversize waveguide section with minimal power reflection. Because of its increased size, the electric fields of the fundamental mode at the oversize waveguide section are reduced as compared to the field strengths at the input port of the termination.

It is seen the tapered waveguide transforming section and oversize waveguide section are rectangular waveguides having broad walls 12, 14, and sidewalls 16, 18, which meet a the junction 11*b* of the two waveguide sections 11 and 11*a*. The size of the input port 13*a* will depend on the operating frequency and the size of over size waveguide can determined based on the application. As an example, an X-band waveguide termination in accordance with the invention has been constructed with an input port sized to mate with a WR 112 waveguide, and a stepped up oversize waveguide section having an approximately 1¾ inch broad wall dimension and an approximately ¾ inch narrow wall dimension.

While, in the preferred embodiment of the invention, the waveguide sections of the termination, including the waveguide input port are rectangular guides, it shall be understood that it is not intended that the invention be limited to rectangular guides. For example, it is contemplated the invention could be used with circular waveguide sections having a fundamental $TE_{11}$ mode, which is similar to a $TE_{01}$ mode in a rectangular guide. It shall also be appreciated that the waveguide sections 11, 11*a* can be fabricated as a single part or in two (or more) parts joined together.

It will still further be appreciated that, while use of a tapered transformer section to step up from the input port 13*a* to the oversize waveguide section 11*a* is considered to be the best mode of the invention, the use of other transformer sections would be possible, such as a step transformer.

Waveguide termination 10 further includes a dielectric taper 25 positioned in oversize waveguide section 11*a* for carrying water into and out of this section of the termination. The dielectric taper is suitably a thin walled, hollow cone which extends from the manifold end block 19 toward the power receiving end 13 of the termination, where the small point end 29 of the taper will face into the incident microwave power received by the termination. As is most clearly shown in FIG. 1, the dielectric taper 25, whose shape is characterized by the fact that its cross-sectional dimension decreases substantially uniformly from its base to its point end, is inclined with respect to the center axis "A" of waveguide sections 11, 11*a*, such that the point end 29 of the taper lies close to the oversize waveguide narrow sidewall 18*a*. Thusly inclined, it can be seen that the point end of the taper is laterally displaced into a region of very low electric field for the fundamental waveguide mode for a rectangular guides.

More specifically, the fundamental waveguide mode is the $TE_{10}$ rectangular mode which has only one component of electric field represented by an electric field vector extending between the broad walls of the guide. The field vector of the $TE_{10}$ mode diminishes to zero at the side walls from a maximum field strength at the center of the guide. The point end 29 of the dielectric taper, due to the taper's inclined position relative to the guide axis, is therefore positioned to avoid abrupt transitions as seen by the electric field. This inclination of the taper significantly decreases the perturbation in the electric field of the incident microwave power and results in a good broadband match for the waveguide termination.

The taper preferably has a length that causes its point end 29 to extend substantially to or just beyond the junction 11*b* of waveguide sections 11 and 11*a*. By maximizing the length of the taper in the oversize waveguide section the volume of water carried through the taper will be maximized. It is noted that the largest possible diameter of the taper at its base end 28 is dictated by the separation distance between the broad walls of the oversize waveguide section as shown in FIG. 2.

Water is supplied to dielectric taper 25 from the back end of the oversize waveguide section from a manifold end block 19 supported on an angled flange 17 at and defining the back end of the oversize guide. The manifold end block has a fluid inlet passage 21 and a fluid outlet passage 23 that communicate through inlet port 22 and outlet port 24 with the hollow interior of the taper. The taper's base end 28 suitably has a maximum dimension slightly greater than a round hole (not shown) in the flange 17, such that the taper's base end can be wedge fit into the flange hole and can be sealed to the manifold end block by O-ring 26.

Fluid circulation in the dielectric taper is achieved through a fluid circulating passage, which conducts a fluid, typically water, fed under pressure through the manifold end block from taper's base end 28 to its point end 29 and back, where it can exit through fluid outlet passage 23. To achieve such fluid circulation FIGS. 1-3 show a planar divider 31 shaped to fit closely into the interior hollow contour of the dielectric taper 25 and extending into and soldered to the end block cavity 32; the divider is of a length whereby it will extend nearly the length of the taper, save for a small end cavity area 33 at the taper's point end. Inserted within the taper as shown, the planar divider 31 lengthwise divides the hollow 30 of the taper into adjacent and connected fluid passages 35, 37 which communicate, respectively, with the fluid inlet passage 21 and the fluid outlet passage 23.

The arrows in FIG. 2 illustrate a manner in which fluid will sweep the entire taper interior, with the divider being long enough to force the fluid to the cavity area 33 at the extreme end of the taper. To reduce the pressure necessary for an adequate volume flow of fluid, the divider's point end 39 is drilled with holes 41, 43.

It is noted that the planar divider 31 within the conical taper 25 must be capable of supporting the resultant force caused by differential fluid pressures on opposite sides of the divider, a differential which is principally produced by a pressure drop through the constructed portions of the taper passages. A metal divider is preferable in this regard, however, a dielectric divider could be used. It is also noted that a metal divider would preferably be oriented parallel to the plane of the oversize waveguide broad walls connecting to 12, 14, such that the electric field vectors of the fundamental waveguide mode, i.e. the $TE_{10}$ rectangular mode, are perpendicular to the metal surface of the divider. With such an orientation the divider will have an insignificant effect on the modal field patterns and therefore will not produce any appreciable power reflection. Though the above described orientation of the metal divider 31 is the preferred orientation, it is found that the metal divider can be oriented in any direction with respect to the $TE_{10}$ electric field without a substantial deleterious effect.

The use of a metal planar divider 31 also acts as a good conductor for transferring heat from the fluid and for conducting heat to the end block 19 at the back end of the waveguide section. The end block, preferably metal, also serves as a fluid cooled heat sink.

By sweeping the interior of the hollow taper with a power absorbing fluid, the microwave energy received by the waveguide termination 10 will be dissipated within the taper in the form of heat. By providing a relatively large taper in a oversize waveguide section of the termination, power dissipation capabilities can be increased and the amount of reflective power and overheating the jacketing dielectric material in the taper minimized. It is noted that the taper will also absorb any propagating higher order modes (with reduced power content) with minimal reflection because of the small initial cross section and the gradual transition in the water circulating dielectric taper.

It is noted that a cone shaped taper having a linearly increasing diameter from its point end 29 to its base end 28 is preferred, however, it is contemplated that the dielectric taper could as well have other shapes or non-linear taper so long as the taper can be properly inclined to place the taper's point end substantially against the sidewall. The preferred circular cross-section will better support the hoop stresses resulting from expected internal fluid pressures of 90 PSIG or more. Moldable, high pressure, low loss plastic, such as polypropylene or Teflon, can suitably serve as the taper material.

It is further noted that the reducing cross section of the dielectric taper as the fluid travels to the tip 19 increases the water velocity and hence the fluid heat transfer from the dielectric jacket to the water. This further protects the dielectric tip region from overheating within the dielectric.

Figure 4:
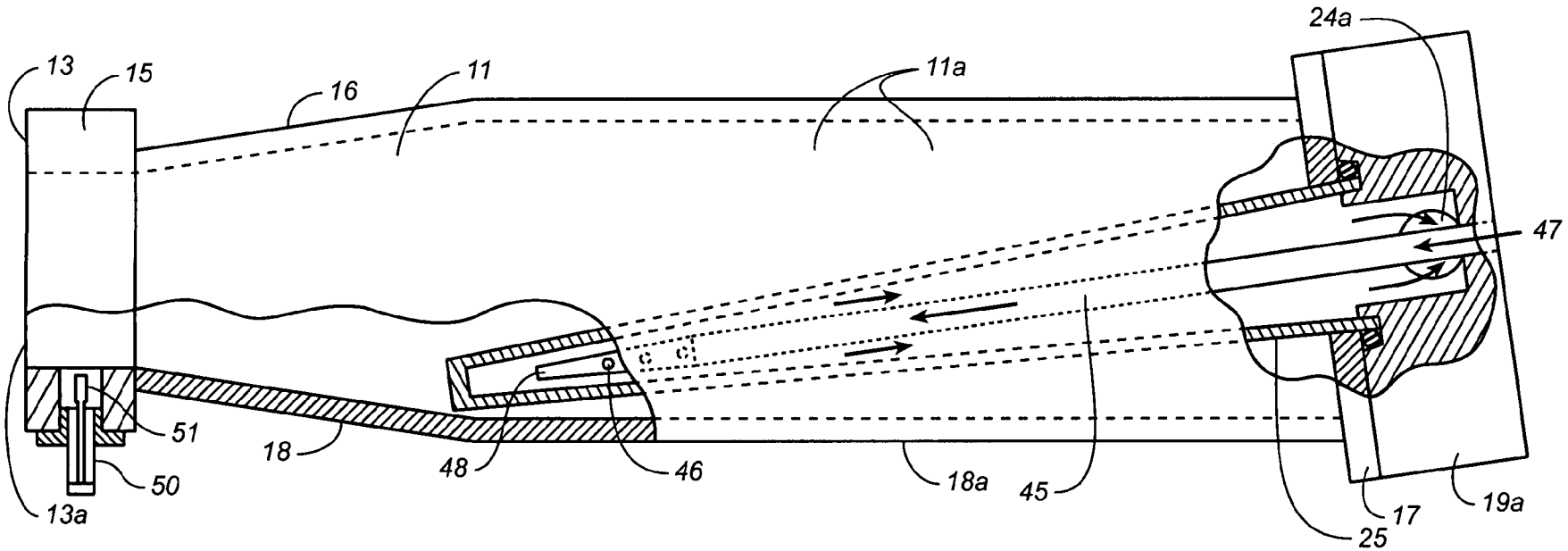
FIG. 4 is a top plan view, in partial cross-section, of an alternative embodiment of the waveguide termination of the present invention.

FIG. 4 illustrates an alternative fluid flow method utilizing a tube 45 coaxially extending into the dielectric taper 25. This tube, which is preferably fabricated of a dielectric material, but which could be made of metal, essentially replaces the bifurcating fin of the preferred embodiment. Fluid is forced down the tube from the tube's fluid inlet 47 to its tip 48. A hole and the end of the tube as well as holes 46 in the tube wall allow water to flow back to the manifold end block within the space between the tube and the outside dielectric taper.

An additional and alternative feature of this waveguide termination of the invention is a unique monitoring probe for sampling the microwave power received and absorbed by the water load. A coaxial connector 50 is threaded into perimeter wall 15*a* of input flange 15 at the side of the narrow wall 15*b* of the waveguide termination's input port 13. A probe hole 15*c* threaded to at least a portion of its depth is provided through the flange from perimeter wall 15*a* for this purpose. The coaxial connector is used to monitor the longitudinal magnetic field at the narrow wall of the flange's rectangular opening. The waveguide magnetic field couples to a cutoff $TE_{11}$ cylindrical mode in the probe hole 15*c*. This $TE_{11}$ cylindrical mode decays rapidly from the inside of the flange wall, but has both a transverse component magnetic field parallel to the driving $TE_{10}$ magnetic field and a transverse electric field normal to the magnetic $TE_{11}$ field. By inclining the center conductor 51 of coaxial connector 50 to receive this electric field, the probe can be designed to effectively sample the waveguide magnetic field and hence the power terminated (assuming a well matched termination). It has been found that extending and increasing the inner connector diameter increases the coupling factor, and that minus 60 db coupling can be readily achieved.

Therefore, it can be seen that the present invention provides a power absorbing termination that can handle very high peak and average power at the higher microwave frequencies or extremely high power at lower microwave frequencies by utilizing field reduction in an oversize waveguide. This termination has relatively low VSWR characteristics over the input waveguide operating bandwidth, and which will operate efficiently in any orientation and under conditions of changing orientations such as may be encountered in certain applications. While the invention has been described in considerable detail in the forgoing specification, it is not intended that the invention be limited to such detail except as necessitated by the following claims.

What I claim is:

1. A power absorbing waveguide termination for a waveguide transmission line comprising a power receiving end for attaching to a waveguide transmission line, said power receiving end having a waveguide input port for receiving power from the waveguide transmission line to which it is attached, an oversize waveguide section which is larger, in cross-section, than the waveguide input port of said power receiving end, said oversize waveguide section having a center axis and a back end, a waveguide transformer section between said power receiving end and said oversize waveguide section, a manifold end block at the back end of said oversize waveguide section, said manifold end block having a fluid inlet passage and fluid outlet passage, and a dielectric taper having a point end and a base end fluidly connected to said manifold end block, said taper extending from its base end into said oversize waveguide section, and being inclined relative to the center axis of said oversize waveguide section so as to position the point end of said dielectric taper in a region of relatively low electric field strength within a portion of the waveguide termination formed by said tapered waveguide section and oversize waveguide section, said dielectric taper having fluid circulating passage therein in communication with the fluid inlet passage and fluid outlet passage of said manifold end block, wherein a fluid can be circulated from said manifold end block through said taper from the base end to the point end thereof and back to absorb microwave power received from the waveguide transmission line to which the power absorbing termination is attached.

2. The waveguide termination of claim 1 wherein said oversize waveguide section is a rectangular waveguide comprised of narrow walls and broad walls, and wherein the dielectric taper is inclined in the direction of one of said narrow walls thereof.

3. The waveguide termination of claim 1 wherein said dielectric taper extends for substantially the entire length of said oversize waveguide section.

4. The waveguide termination of claim 1 wherein said dielectric taper extends for at least the length of said oversize waveguide section.

5. The waveguide termination of claim 1 wherein base end of said dielectric taper is sized to substantially maximize the cross-sectional size of the base end of the taper at the back end of said oversize waveguide section.

6. The waveguide termination of claim 1 wherein said dielectric taper wherein said taper has a conical shape and wherein the diameter of the base end of said taper is approximately equal to the minimum dimension of said oversize waveguide at the back end thereof.

7. The waveguide termination of claim 1 wherein said dielectric taper is hollow and the fluid circulating passage therein is formed by a planar divider which lengthwise divides said hollow into adjacent fluid passages fluidly connected at the point end of said taper and which is in fluid communication with the fluid inlet and outlet passages of said manifold end block.

8. The waveguide termination of claim 1 wherein the fluid circulating passage therein is formed by a center tube in fluid communication with the fluid inlet passage of said fluid manifold block, and wherein said center tube extends into said dielectric taper to convey fluid to the point end of the taper, and forms an outer coaxial return fluid passage in fluid communication with the fluid outlet passage of said fluid manifold block.

9. The waveguide termination of claim 1 wherein said waveguide transformer section is a tapered section of waveguide.

10. The waveguide termination of claim 9 wherein said planar divider is disposed in a axial plane which is perpendicular to the electric fields for the fundamental mode for said waveguide section.

11. The waveguide termination of claim 1 further comprising a power monitoring probe at said power receiving end for monitoring the microwave power supplied by to the waveguide termination.

12. The waveguide termination of claim 11 wherein the a waveguide flange is provided at said power receiving end, said waveguide flange having a perimeter wall and a probe hole extending from said perimeter wall to said waveguide input port, and wherein said power monitoring probe extends into said probe hole in said flange for detecting attenuated microwave energy coupled from waveguide input port to said probe hole in a region of said waveguide input port having low electric field strengths and high magnetic field strengths for the fundamental mode of the waveguide.

13. The waveguide termination of claim 12 wherein said monitoring probe is comprised of a coaxial connector inserted into said probe hole, said coaxial connector having an extending center conductor bent to receive the cutoff electric field within said probe hole.

14. A power absorbing waveguide termination for a waveguide transmission line comprising a power receiving end for attaching to a waveguide transmission line, said power receiving end having a rectangular waveguide input port for receiving power from the waveguide transmission line to which it is attached, rectangular waveguide sections following said rectangular input port, said rectangular waveguide sections including an oversize waveguide section which is larger, in cross-section, than the waveguide input port of said power receiving end and which has a back end, and a waveguide transformer section between said power receiving end and said oversize waveguide section, said rectangular waveguide sections being characterized by broad walls and narrow walls, a manifold end block at the back end of said oversize waveguide section, said manifold end block having a fluid inlet passage and fluid outlet passage, and a conical dielectric taper having a point end and a base end fluidly connected to said manifold end block, said taper extending from its base end into said oversize waveguide section, and being inclined within said oversize waveguide section in the direction of one of the narrow walls thereof, said dielectric taper having fluid circulating passage therein in communication with the fluid inlet passage and fluid outlet passage of said manifold end block, wherein a fluid can be circulated from said manifold end block through said taper from the base end to the point end thereof and back to absorb microwave power received from the waveguide transmission line to which the power absorbing termination is attached.

15. The waveguide termination of claim 14 wherein said conical dielectric taper extends for substantially the entire length of said oversize waveguide section.

16. The waveguide termination of claim 14 wherein said conical dielectric taper extends for at least the length of said oversize waveguide section.

17. The waveguide termination of claim 14 wherein the diameter of the base end of said dielectric taper is approximately equal to distance between the broad walls of said rectangular oversize waveguide section.

18. The waveguide termination of claim 14 wherein the diameter of the base end of said dielectric taper and the length of said taper are substantially maximized within said oversize waveguide section.

19. A power absorbing waveguide termination for a waveguide transmission line comprising an oversize waveguide section which is oversized, in cross-section, as compared to the size of waveguide transmission line to which the waveguide termination is attached, said oversize waveguide section being matched to the waveguide transmission line, and a fluid carrying dielectric taper having a point end disposed in said oversize waveguide section, and inclined therein so as to position the point end of said dielectric taper in a region of relatively low electric field strength within the oversize waveguide section, said dielectric taper having fluid circulating passage for circulating fluid therethrough received from a fluid source so as to absorb microwave power received from the waveguide transmission line to which the power absorbing termination is attached, which is conducted into said oversize waveguide section.

20. The waveguide termination of claim 19 wherein the diameter of the base end of said dielectric taper and the length of said taper are substantially maximized within said oversize waveguide section.

* * * * *

UNITED STATES PATENT AND TRADEMARK OFFICE

CERTIFICATE OF CORRECTION

PATENT NO. : 7,283,014 B2
APPLICATION NO. : 11/259638
DATED : October 16, 2007
INVENTOR(S) : Ray M. Johnson It is certified that error appears in the above-identified patent and that said Letters Patent is hereby corrected as shown below:

Column 2, line 16, “a n improved” should read --an improved--.
Column 2, line 22, “less that” should read --less than--.
Column 3, line 23, --a-- should be inserted between “includes” and “power”.
Column 4, line 28, “in inclined” should read --an inclined--.
Column 4, line 39, “coax” should read --coaxial--.
Column 5, line 13, --that-- should be inserted between “seen” and “the”.
Column 5, line 15, “meet a” should read --meet at--.
Column 5, line 18, “of over size” should read --of the oversize--.
Column 5, line 18, --be-- should be inserted between “can” and “determined”.
Column 5, line 58, “a” should be deleted from between “for” and “rectangular”.
Column 6, line 29, --the-- should be inserted between “from” and “taper’s”.
Column 7, line 8, “a oversize” should read --an oversize--.
Column 7, line 38, “hole and the end” should read --hole at the end--.
Column 8, line 56, --the-- should be inserted between “wherein” and “base”.
Column 8, line 61, “wherein said taper” should be deleted from between “dielectric taper” and “has”.
Column 9, line 17, “a axial” should read --an axial--.
Column 9, line 22, “by” should be deleted from between “supplied” and “to”.
Column 9, line 24, “a” should be deleted after “wherein the”.

Signed and Sealed this

Eleventh Day of March, 2008

JON W. DUDAS
*Director of the United States Patent and Trademark Office*